US012228366B2

(12) United States Patent
Bernal

(10) Patent No.: US 12,228,366 B2
(45) Date of Patent: Feb. 18, 2025

(54) TACTICAL WEAPON-MOUNTED ACCESSORY LOCKING DEVICE, AND ASSOCIATED METHODS

(71) Applicant: Jacob Matthew Bernal, Bozeman, MT (US)

(72) Inventor: Jacob Matthew Bernal, Bozeman, MT (US)

( * ) Notice: Subject to any disclaimer, the term of this patent is extended or adjusted under 35 U.S.C. 154(b) by 0 days.

(21) Appl. No.: 18/456,366

(22) Filed: Aug. 25, 2023

(65) Prior Publication Data

US 2024/0219144 A1 Jul. 4, 2024

Related U.S. Application Data

(60) Provisional application No. 63/355,630, filed on Jun. 26, 2022.

(51) Int. Cl.
*F41C 27/00* (2006.01)

(52) U.S. Cl.
CPC ..... *F41C 27/00* (2013.01)

(58) Field of Classification Search
CPC ..... F41C 27/00; F41C 33/0263; F41C 33/02; F41G 1/393; F41G 11/001; F41G 11/00; F41A 23/18; F41A 17/00; F41A 17/46
See application file for complete search history.

(56) References Cited

U.S. PATENT DOCUMENTS

| | | | | |
|---|---|---|---|---|
| 4,198,026 | A * | 4/1980 | Capolupo | F41A 17/02 42/70.07 |
| 6,385,890 | B1 * | 5/2002 | Amadini | F41A 17/02 42/70.07 |
| 9,482,482 | B1 * | 11/2016 | Sanders | A47B 81/005 |
| 10,641,575 | B1 * | 5/2020 | Coulombre | F41C 27/00 |
| 11,874,090 | B2 * | 1/2024 | Teetzel | F41G 11/00 |
| 2014/0150326 | A1 * | 6/2014 | Nettleton | F41G 1/545 42/120 |
| 2014/0317988 | A1 * | 10/2014 | Battis | F41G 1/36 42/114 |
| 2017/0122010 | A1 * | 5/2017 | McCanna | A47B 81/00 |
| 2022/0341708 | A1 * | 10/2022 | Teetzel | F41A 35/02 |

* cited by examiner

*Primary Examiner* — Joshua E Freeman
(74) *Attorney, Agent, or Firm* — Collaborative IP; Paul Ditmyer

(57) ABSTRACT

The locking device is for a weapon-mounted accessory configured to be mounted to a weapon station including an accessory locking structure. The locking device includes a U-shaped body including protective plates configured to cover both the accessory locking structure of the weapon station and at least one weapon-mounted accessory mounting fastener, at least one anti-rotation tab coupled to the U-shaped body and configured to prevent rotation of a lock body coupled to the accessory locking structure, and a lock shackle coupled to the U-shaped body and configured to align with a shackle eye of the accessory locking structure.

19 Claims, 6 Drawing Sheets

TACTICAL WEAPON-MOUNTED ACCESSORY LOCKING DEVICE, AND ASSOCIATED METHODS

RELATED APPLICATIONS

This application claims priority to U.S. Provisional Application Ser. No. 63/355,630 filed Jun. 26, 2022 titled "SMALL TACTICAL LASER RANGEFINDER LOCKING DEVICE which is incorporated herein in its entirety by reference.

FIELD

The present invention relates in general to the field of weapon accessories, and particularly to a locking device for securing a rifle accessory to the weapon.

BACKGROUND

The Common Remotely Operated Weapon Station (CROWS) is a technology system that has been developed by the United States military to provide soldiers with the capability to operate weapons systems from inside protected vehicles. This innovative technology has revolutionized the way soldiers operate in combat zones, increasing their safety and efficiency on the battlefield. The structure of the CROWS system is complex, incorporating various components that work together to provide soldiers with the ability to operate weapons systems from a remote location.

At its core, the CROWS system consists of a weapons station that is mounted on a vehicle, allowing the operator to remotely control the weapons system. The weapons station is equipped with a variety of advanced sensors and targeting systems that allow the operator to aim and fire the weapon with pinpoint accuracy. This targeting system includes a variety of cameras and sensors, including a thermal camera, a low-light camera, and a laser rangefinder, all of which provide the operator with a clear view of the battlefield.

The CROWS system also includes a control station that is located inside the vehicle, allowing the operator to control the weapons system from a safe and protected location. The control station is equipped with a range of advanced communication systems, including radios and satellite links, which allow the operator to stay in constant contact with other soldiers and commanders on the battlefield. This communication system also enables the operator to receive real-time intelligence and surveillance data, which can help to inform their decision-making and improve the effectiveness of their operations.

In addition to the weapons station and control station, the CROWS system also includes a variety of other components that are essential for its operation. These include power supplies, cooling systems, and backup systems that ensure the system remains operational in even the most challenging environments. The system also incorporates advanced cybersecurity features, including encryption and authentication protocols, which help to ensure that the system remains secure and protected against hacking and other forms of cyber-attack.

The structure of the CROWS system is highly modular and adaptable, allowing it to be easily customized and configured to meet the specific needs of different military units and operational environments. For example, the system can be equipped with a variety of different weapons systems, including machine guns, grenade launchers, and anti-tank missiles, depending on the needs of the mission. It can also be configured for use on a wide range of different vehicles, including armored personnel carriers, Humvees, and even boats and aircraft.

One of the key benefits of the CROWS system is its ability to enhance the situational awareness of soldiers on the battlefield. By allowing operators to remotely control weapons systems, the system enables soldiers to engage targets from a safe and protected location, reducing their exposure to enemy fire and improving their overall safety. The system also allows soldiers to maintain a 360-degree view of their surroundings, providing them with a greater awareness of the battlefield and enabling them to respond quickly to emerging threats.

In sum, the structure of the CROWS is complex and highly advanced, incorporating a range of different components that work together to provide soldiers with the ability to operate weapons systems from a remote location. The system is highly modular and adaptable, allowing it to be customized and configured to meet the specific needs of different military units and operational environments. By enhancing the situational awareness of soldiers on the battlefield and reducing their exposure to enemy fire, the CROWS system is an invaluable tool for modern military operations, helping to keep soldiers safe and increasing the effectiveness of their missions.

The AN/PSQ-23 Small Tactical Optical Rifle Mounted (STORM) laser rangefinder is a highly advanced targeting system developed by the United States military. This innovative technology is designed to provide soldiers with enhanced targeting capabilities, allowing them to engage targets with greater accuracy and precision.

The STORM system incorporates a high-powered laser rangefinder that can accurately measure the distance to a target up to several kilometers away. This information is then transmitted to the operator, allowing them to adjust their aim and fire their weapon with greater accuracy. The system also includes advanced targeting and ballistic calculation software that helps to account for factors such as wind and bullet drop, further improving the accuracy of the system.

One of the key benefits of the STORM system is its compact size and lightweight design, which allows it to be easily mounted on a variety of different weapons platforms.

The STORM laser rangefinder is designed to be mounted on a variety of different weapon stations, including rifles and machine guns. The mounting process for the STORM system is relatively straightforward and can be completed quickly and easily in the field.

To mount the STORM system on a weapon station, the operator must first ensure that the weapon is unloaded and the safety is engaged. They must then locate the mounting bracket on the weapon, which is typically located on the top rail of the weapon. Next, the operator must align the mounting bracket on the STORM system with the mounting bracket on the weapon and slide the STORM system onto the bracket until it clicks into place. The operator must then tighten the mounting screws on the STORM system to secure it in place.

Once the STORM system is securely mounted on the weapon station, the operator can begin using it to measure distances to targets and improve the accuracy and precision of their engagements. The system can be easily removed from the weapon station by reversing the mounting process, allowing it to be used on a different weapon or stored when not in use.

The STORM laser rangefinder can be locked to the weapon station to ensure that it remains securely attached during use. The mounting bracket on the STORM system typically includes locking mechanisms such as screws or levers that can be tightened or engaged to prevent the system from becoming detached from the weapon station during operation. This locking mechanism helps to ensure the stability and accuracy of the STORM system while in use, which is essential for the safety and effectiveness of soldiers on the battlefield.

The STORM is bore sighted by maintenance personnel and loses its accuracy when removed by unauthorized personnel. The CROWS features a shackle eye and lock that are intended to prevent access to one of the STORM locking screws. This system is inadequate and often subverted.

A locking device may be desired to enhance physical security of the STORM.

This background information is provided to reveal information believed by the applicant to be of possible relevance to the present invention. No admission is necessarily intended, nor should be construed, that any of the preceding information constitutes prior art against the present invention.

SUMMARY OF THE EMBODIMENTS

The present invention is directed to a locking device for a weapon-mounted accessory configured to be mounted to a weapon station including an accessory locking structure. The locking device includes a U-shaped body including protective plates configured to cover both the accessory locking structure of the weapon station and at least one weapon-mounted accessory mounting fastener, at least one anti-rotation tab coupled to the U-shaped body and configured to prevent rotation of a lock body coupled to the accessory locking structure, and a lock shackle coupled to the U-shaped body and configured to align with a shackle eye of the accessory locking structure.

Additionally, and/or alternatively, the at least one anti-rotation tab comprises an upper anti-rotation tab and a lower anti-rotation tab. As such, the lock shackle may be positioned between the upper anti-rotation tab and lower anti-rotation tab.

Additionally, and/or alternatively, the lock shackle comprises a lock shackle eye configured to align with the shackle eye of the accessory locking structure.

Additionally, and/or alternatively, the protective plates of the U-shaped body are configured to cover multiple weapon-mounted accessory mounting fasteners.

Additionally, and/or alternatively, the protective plates of the U-shaped body include a top plate configured to prevent the use of bolt cutters to access the accessory locking structure.

Additionally, and/or alternatively, the protective plates of the U-shaped body include at least one relief configured to provide space for fastener heads on the weapon station.

Additionally, and/or alternatively, the weapon station is the US Military Common Remotely Operated Weapon Station (CROWS).

Additionally, and/or alternatively, the weapon-mounted accessory is the AN/PSQ-23 Small Tactical Optical Rifle Mounted (STORM) laser rangefinder.

Additionally, and/or alternatively, the U-shaped body is formed of steel.

Another embodiment is directed to a locking device for a AN/PSQ-23 Small Tactical Optical Rifle Mounted (STORM) laser rangefinder mounted to a US Military Common Remotely Operated Weapon Station (CROWS) that includes a locking structure.

The locking device includes a U-shaped body including protective plates configured to cover both the locking structure of the CROWS and at least one STORM mounting fastener, at least one anti-rotation tab coupled to the U-shaped body and configured to prevent rotation of a lock body coupled to the accessory locking structure, and a lock shackle coupled to the U-shaped body and configured to align with a shackle eye of the locking structure.

Additionally, and/or alternatively, the at least one anti-rotation tab comprises an upper anti-rotation tab and a lower anti-rotation tab. As such, the lock shackle may be positioned between the upper anti-rotation tab and lower anti-rotation tab.

Additionally, and/or alternatively, the lock shackle comprises a lock shackle eye configured to align with the shackle eye of the locking structure.

Additionally, and/or alternatively, the protective plates of the U-shaped body are configured to cover multiple STORM mounting fasteners.

Additionally, and/or alternatively, the protective plates of the U-shaped body include a top plate configured to prevent the use of bolt cutters to access the locking structure.

Additionally, and/or alternatively, the protective plates of the U-shaped body include at least one relief configured to provide space for fastener heads on the CROWS.

Additionally, and/or alternatively, the U-shaped body is formed of steel.

BRIEF DESCRIPTION OF THE DRAWINGS

The example embodiments are best understood from the following detailed description when read with the accompanying drawing figures. In fact, the dimensions may be arbitrarily increased or decreased for clarity of discussion. Wherever applicable and practical, like reference numerals refer to like elements.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
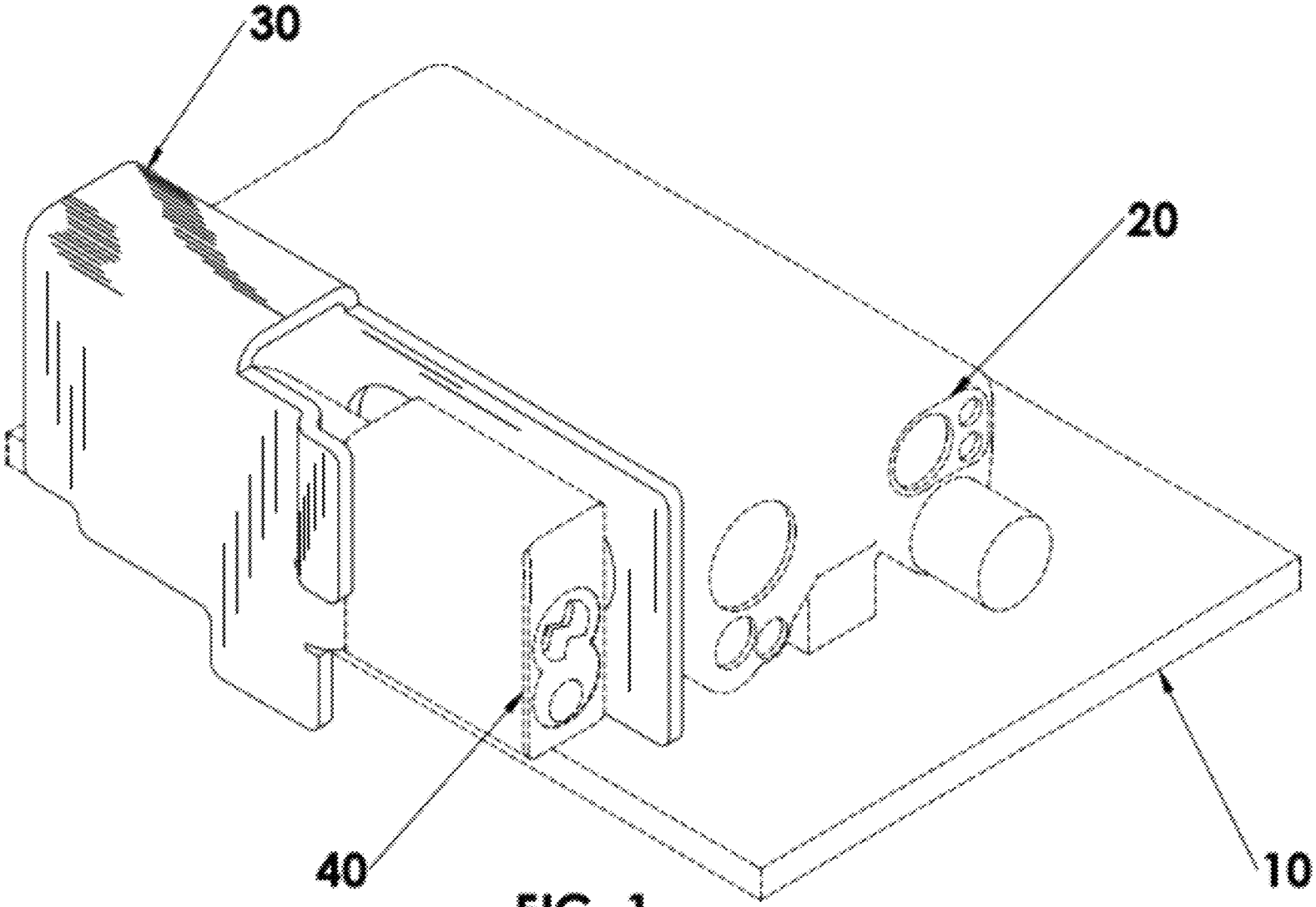
FIG. 1 is a perspective view illustrating an example embodiment of a locking device in accordance with features of the present invention, and installed on the CROWS assembly with the STORM Laser also installed.
Figure 2:
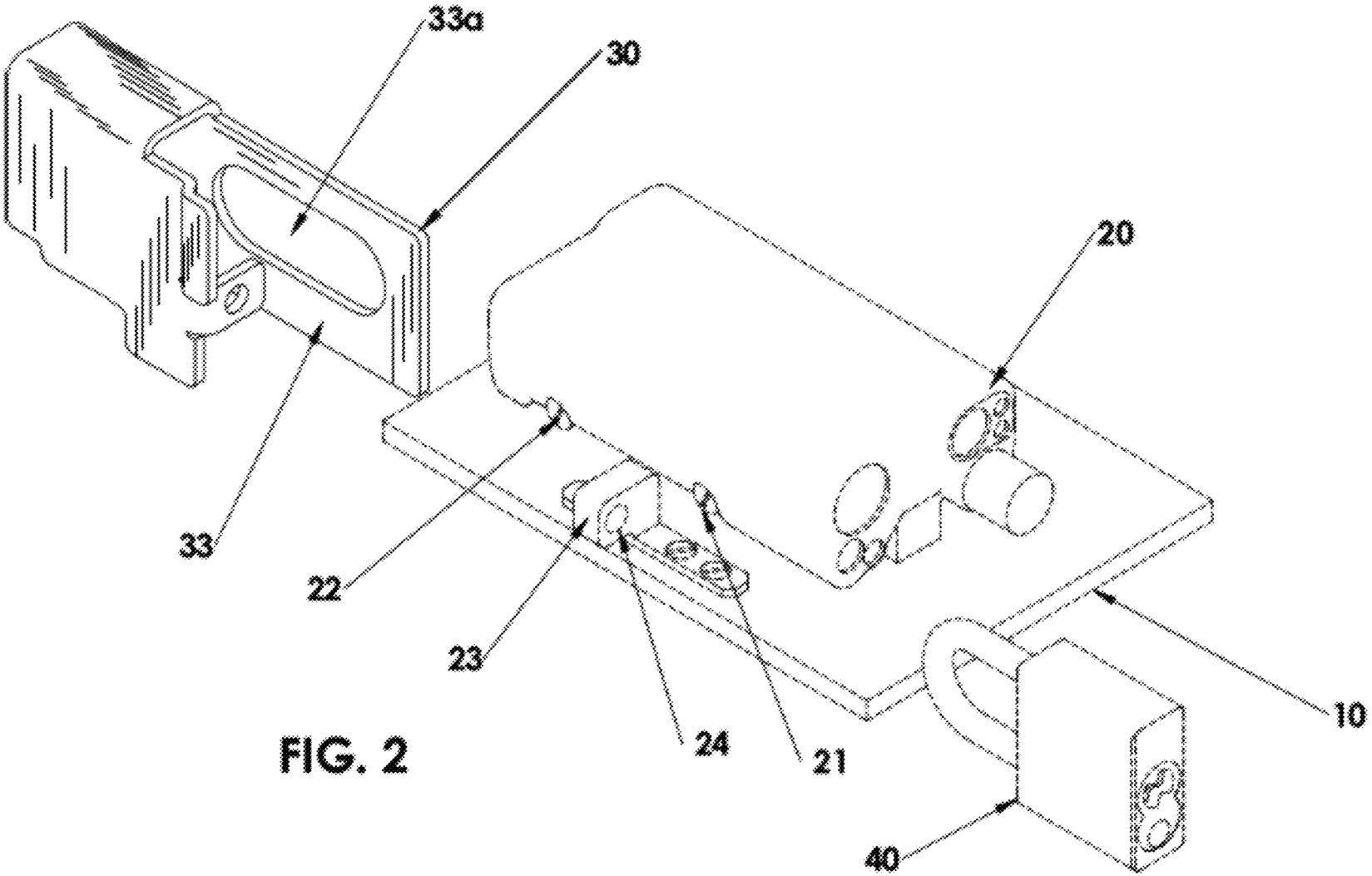
FIG. 2 is an exploded view illustrating the example embodiment of the locking device of FIG. 1, in relation to the CROWS assembly with the STORM Laser installed.
Figure 3:
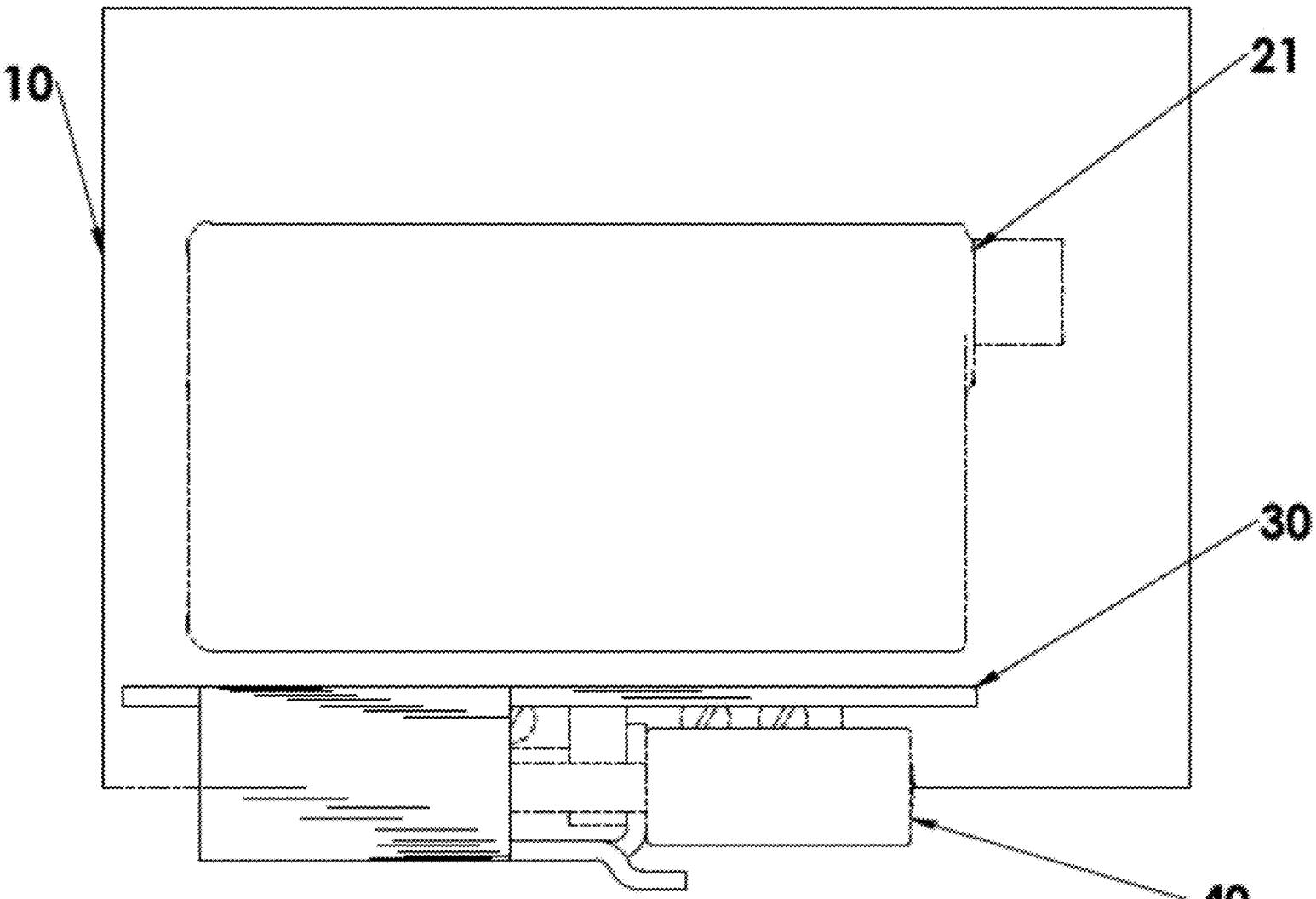
FIG. 3 is a top view illustrating the locking device of FIG. 1.
Figure 4:
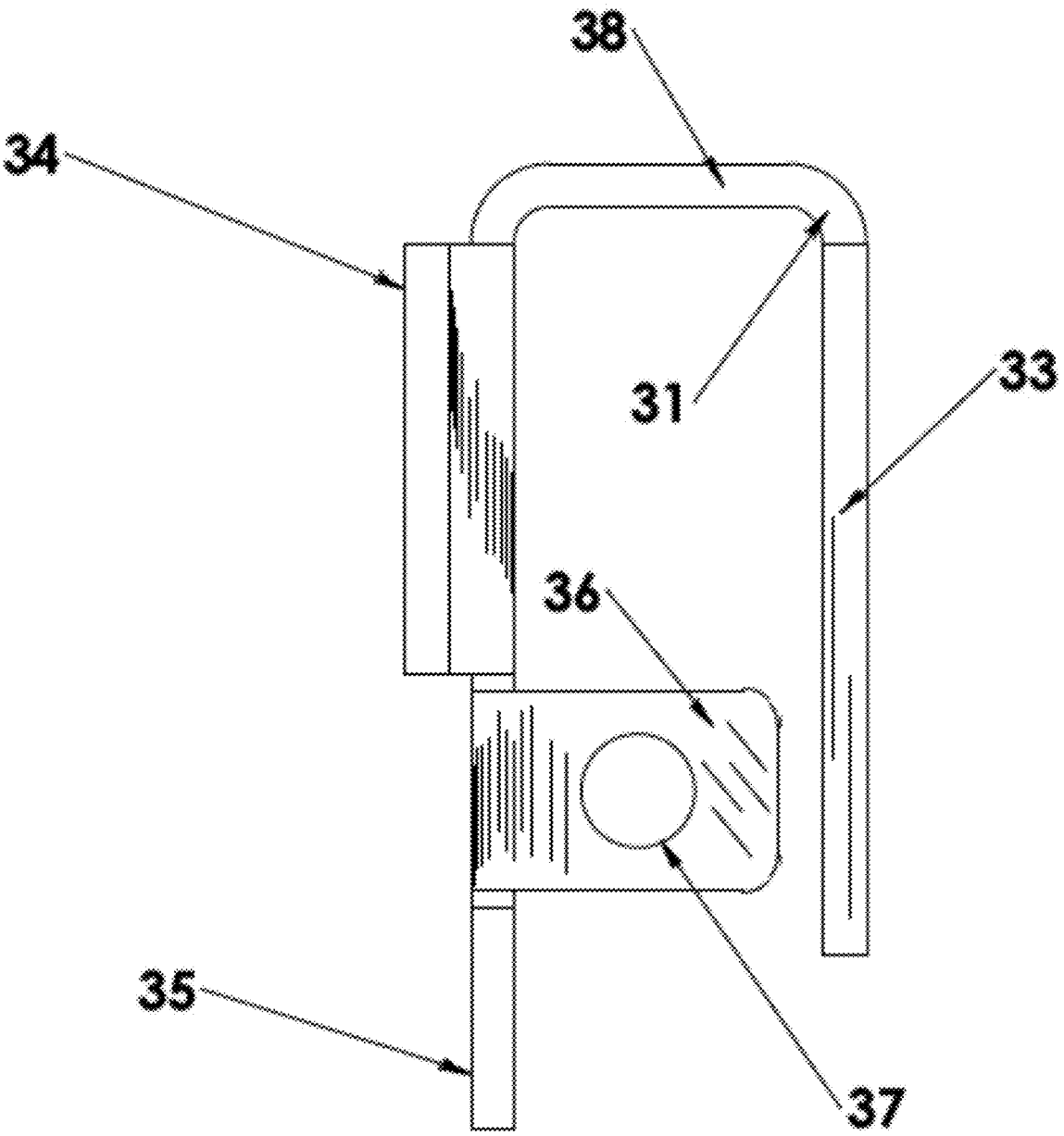
FIG. 4 is a front view of the locking device of FIG. 1 and illustrating the lock shackle.
Figure 5:
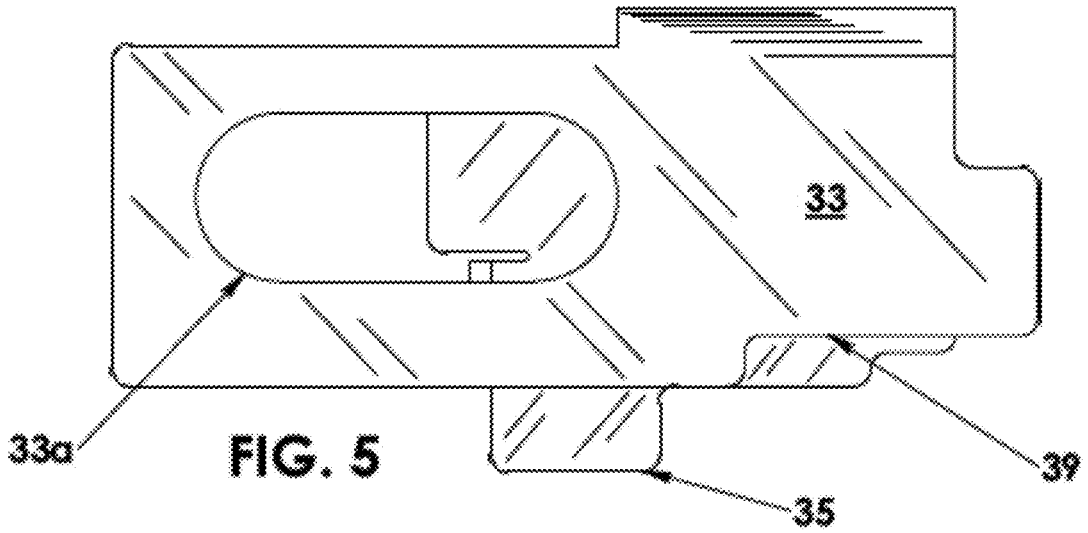
FIGS. 5 and 6 are left and right side views of the locking device of FIG. 1 and illustrating the anti-rotation features that constrain the locking device when locked.
Figure 6:
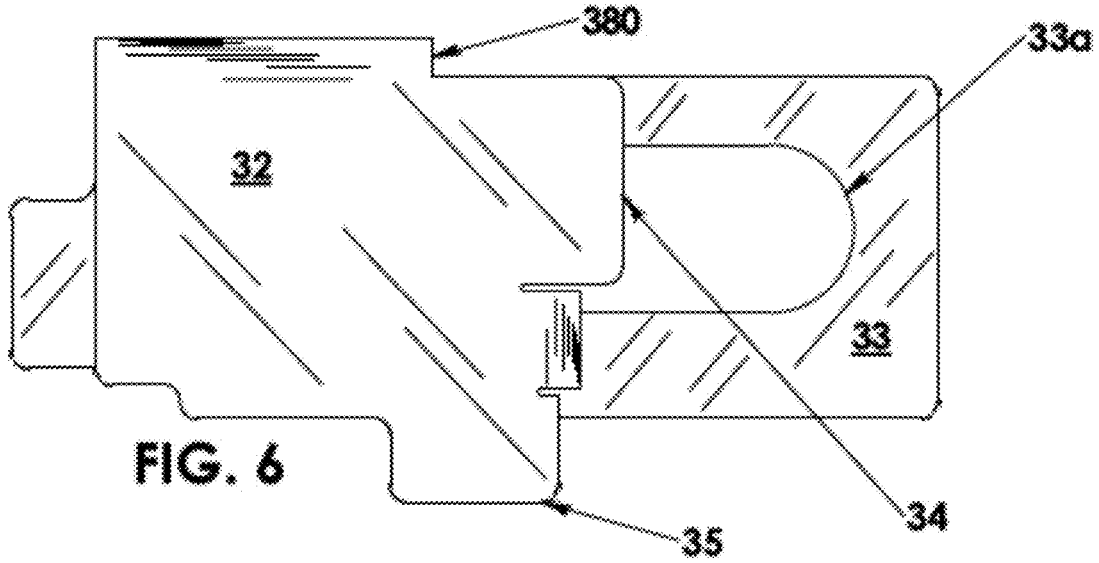
Figure 7:
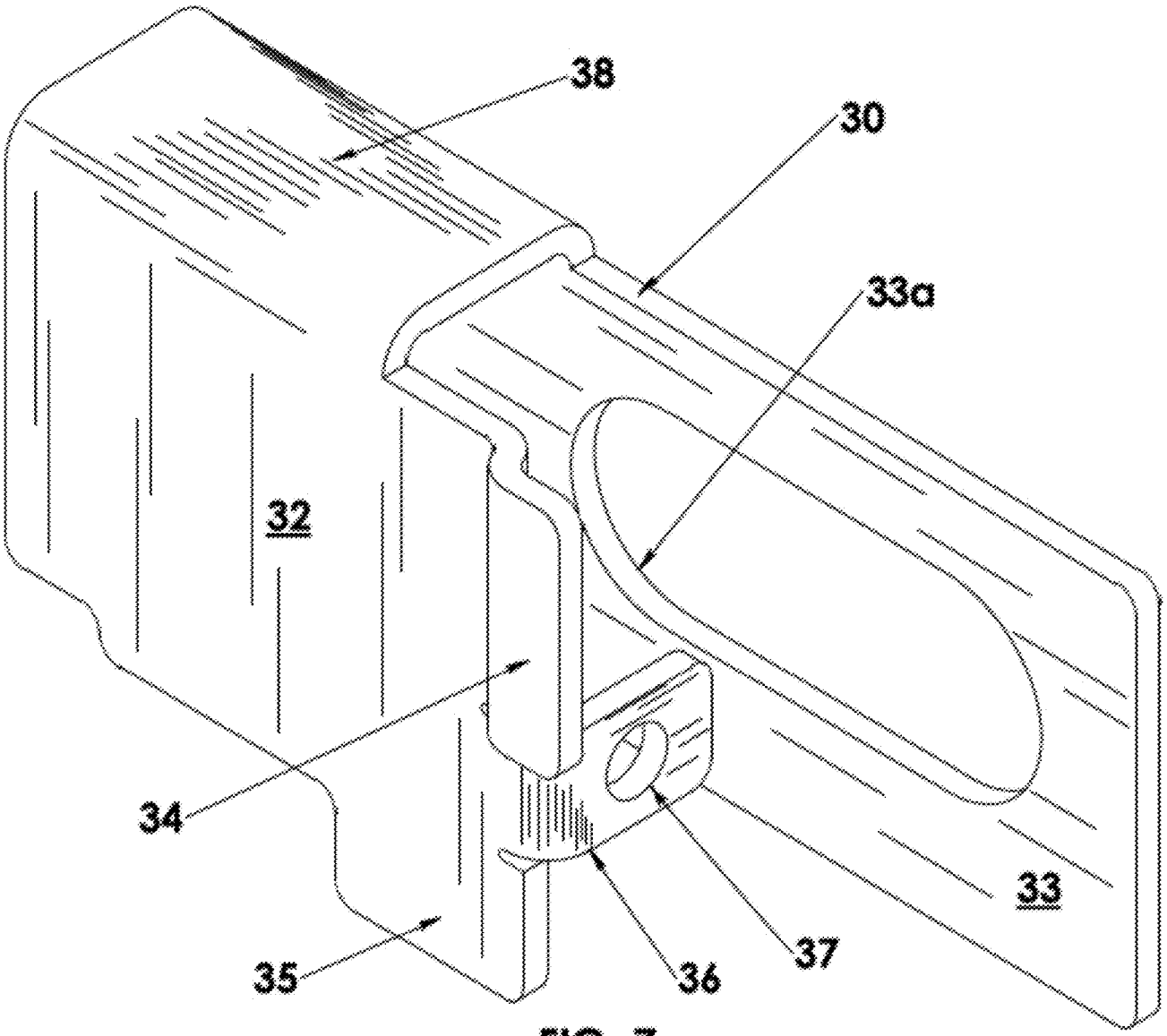
FIG. 7 is a perspective view of the locking device of FIG. 1.

FIGS. 1-7 illustrate an example embodiment of a locking device 30 in accordance with features of the present invention. FIG. 1 is a perspective view illustrating an example embodiment of the locking device 30, and installed on the CROWS assembly baseplate 10 with the STORM Laser 20 also installed. FIG. 2 is an exploded view illustrating the example embodiment of the locking device 30, in relation to the CROWS assembly baseplate 10 with the STORM Laser 20 installed. FIG. 3 is a top view illustrating the locking device 30. FIG. 4 is a front view of the locking device 30. FIGS. 5 and 6 are left and right side views of the locking device 30. FIG. 7 is a perspective view of the locking device 30.

The locking device 30 is designed to act as a security device for the US military laser range finders on remotely operated weapon systems. As discussed, the Common Remotely Operated Weapon Station (CROWS) is utilized on a variety of US military vehicles to engage targets through remote control protecting the operator from enemy fire. The CROWS may utilize the AN/PSQ-23 Small Tactical Optical Rifle Mounted (STORM) laser rangefinder 20 to identify target ranges. The STORM 20 is bore sighted by maintenance personnel and loses its accuracy when removed by unauthorized personnel. The CROWS features a shackle eye 24 and lock 40 that are intended to prevent access to one of the STORM locking screws 21. This system is inadequate and often subverted. The designed locking device 30 enhances physical security of the STORM making use of the pre-existing shackle eye 24 and lock 40 on the CROWS to prevent lock body rotation and also covers the second STORM locking screw 22.

This device 30 prevents the rotation and manipulation of the preinstalled lock body 40 on the Shackle eye of the CROWS. This device 30 covers both unlocking screws 21/22 on the STORM laser 20 preventing access and removal. This device 30 prevents the use of bolt cutters to remove the security lock 40 on the CROWS.

This locking device 30 may secure the AN/PSQ-23 Small Tactical Optical Rifle Mounted (STORM) laser rangefinder 20, for example, on the US Military Common Remotely Operated Weapon Station (CROWS). The AN/PSQ-23A (STORM) is one variant, the AN/PSQ-23B (STORM SLX) is another, and the AN/PSQ-23C (STORM II) is a third, all three can be used on the CROWS.

Thus, the locking device 30 is for a weapon-mounted accessory (e.g. the STORM laser 20) configured to be mounted to a weapon station (e.g. CROWS baseplate 10) including an accessory locking structure 23 (e.g. including shackle eye 24). The locking device 30 includes a U-shaped body 31 including protective plates 32/33 configured to cover both the accessory locking structure 23 of the weapon station and at least one weapon-mounted accessory mounting fastener (e.g. screws 21/22). Preferably, the protective plate 33 covers both or multiple weapon-mounted accessory mounting fasteners (e.g. screws 21/22). As shown in FIG. 2, the protective plate 33 may include an opening **33*a* for control button access to provide access to laser adjustment buttons and clearance for some models. A top plate 38 is configured to prevent the use of bolt cutters to access the accessory locking structure 23. One or more reliefs 39 may be included to provide space for fastener heads or other obstructions on the CROWS system baseplate 10. Such reliefs 39 allow for use of the locking device 30** on a wide variety of CROWS variants and installations.

An upper anti-rotation tab 34 and a lower anti-rotation tab 35 are coupled to the U-shaped body and configured to prevent rotation of a lock body coupled to the accessory locking structure. A lock shackle 36 is coupled to the U-shaped body 31 and configured to align with the shackle eye 24 of the accessory locking structure 23. The lock shackle 36 may be positioned between the upper anti-rotation tab 34 and lower anti-rotation tab 35. The lock shackle 36 preferably includes a lock shackle eye 37 configured to align with the shackle eye 24 of the accessory locking structure 23.

Accordingly, the locking device 30 features anti rotation tabs 34 and 35 that prevent rotation of the lock body 40 or the locking device 30 itself. These tabs prevent individuals from widening the gap between the STORM laser 20 and the locking device 30 which would otherwise allow tools to be inserted to remove the laser 20. The locking device 30 features bolt cutter protection in the form of plates 33, 34, 38 that cover the shackle which will not allow bolt cutters of any type to grab the shackle. Because the locking device 30 also prevents rotation of the lock body 40 even if the top of the shackle is cut it will not release the device 30.

The locking device 30 is secured to the CROWS baseplate by use of a keyed lock 40 that has its shackle pass through the CROWS locking eye 24 and through the device shackle eye 37. The addition of this locking device 30 takes up the slack in the shackle. The thickness of the material used in the shackle eye 37 takes out any remaining slack in the original CROWS locking eye 24. By removing slack in the system it further constrains the lock body 40 into a position that blocks one of the STORM mounting screws 22.

The U-shaped body 31, in a preferred embodiment, may be made out of sheet steel stamped and bent into its final shape. Other embodiments may include casting the device 30, using fasteners such as rivets or security fasteners to assemble the device 30, 3D printing the device 30, or machining the device 30 from metals, plastics, composites, or other suitable materials. Coatings and protective finishes come in many forms and may also be suitable. a preferred coating may be an oxide coating. Phosphate coatings, zinc coatings, chromate coatings, painting, or anodizing are all other options based on material type.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

The invention claimed is:

1. A locking device for a weapon-mounted accessory configured to be mounted to a weapon station including an accessory locking structure, the locking device comprising:

a U-shaped body including protective plates configured to cover both the accessory locking structure of the weapon station and at least one weapon-mounted accessory mounting fastener;

at least one anti-rotation tab coupled to the U-shaped body and configured to prevent rotation of a lock body coupled to the accessory locking structure; and a lock shackle coupled to the U-shaped body and configured to align with a shackle eye of the accessory locking structure.

2. The locking device according to claim 1, wherein the at least one anti-rotation tab comprises an upper anti-rotation tab and a lower anti-rotation tab.

3. The locking device according to claim 2, wherein the lock shackle is positioned between the upper anti-rotation tab and lower anti-rotation tab.

4. The locking device according to claim 1, wherein the lock shackle comprises a lock shackle eye configured to align with the shackle eye of the accessory locking structure.

5. The locking device according to claim 1, wherein the protective plates of the U-shaped body are configured to cover multiple weapon-mounted accessory mounting fasteners.

6. The locking device according to claim 1, wherein the protective plates of the U-shaped body include a top plate configured to prevent the use of bolt cutters to access the accessory locking structure.

7. The locking device according to claim 1, wherein the protective plates of the U-shaped body include at least one relief configured to provide space for fastener heads on the weapon station.

8. The locking device according to claim 1, wherein the weapon station is the US Military Common Remotely Operated Weapon Station (CROWS).

9. The locking device according to claim 8, wherein the weapon-mounted accessory is the AN/PSQ-23 Small Tactical Optical Rifle Mounted (STORM) laser rangefinder.

10. The locking device according to claim 1, wherein the weapon-mounted accessory is the AN/PSQ-23 Small Tactical Optical Rifle Mounted (STORM) laser rangefinder.

11. The locking device according to claim 1, wherein the U-shaped body is formed of steel.

12. A locking device for a AN/PSQ-23 Small Tactical Optical Rifle Mounted (STORM) laser rangefinder mounted to a US Military Common Remotely Operated Weapon Station (CROWS) that includes a locking structure, the locking device comprising:

a U-shaped body including protective plates configured to cover both the locking structure of the CROWS and at least one STORM mounting fastener;

at least one anti-rotation tab coupled to the U-shaped body and configured to prevent rotation of a lock body coupled to the accessory locking structure; and a lock shackle coupled to the U-shaped body and configured to align with a shackle eye of the locking structure.

13. The locking device according to claim 12, wherein the at least one anti-rotation tab comprises an upper anti-rotation tab and a lower anti-rotation tab.

14. The locking device according to claim 13, wherein the lock shackle is positioned between the upper anti-rotation tab and lower anti-rotation tab.

15. The locking device according to claim 12, wherein the lock shackle comprises a lock shackle eye configured to align with the shackle eye of the locking structure.

16. The locking device according to claim 12, wherein the protective plates of the U-shaped body are configured to cover multiple STORM mounting fasteners.

17. The locking device according to claim 12, wherein the protective plates of the U-shaped body include a top plate configured to prevent the use of bolt cutters to access the locking structure.

18. The locking device according to claim 12, wherein the protective plates of the U-shaped body include at least one relief configured to provide space for fastener heads on the CROWS.

19. The locking device according to claim 12, wherein the U-shaped body is formed of steel.

* * * * *